US008950971B2

(12) United States Patent
Greer et al.

(10) Patent No.: US 8,950,971 B2
(45) **Date of Patent: *Feb. 10, 2015**

(54) COMPOSITION AND SYSTEM FOR PREFORMED THERMOPLASTIC ROAD MARKING WITH SEQUENTIAL FEATURES

(71) Applicant: Flint Trading, Inc., Thomasville, NC (US)

(72) Inventors: Robert W Greer, Lexington, NC (US); Vagn K Askjaer, Trinity, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/047,785

(22) Filed: Oct. 7, 2013

(65) Prior Publication Data

US 2014/0165435 A1 Jun. 19, 2014

Related U.S. Application Data

(63) Continuation of application No. 12/592,448, filed on Nov. 25, 2009, now Pat. No. 8,573,882, which is a continuation of application No. 10/816,635, filed on Apr. 2, 2004, now Pat. No. 7,645,503.

(51) Int. Cl.

| | |
|---|---|
| ***E01F 9/06*** | (2006.01) |
| ***G09F 7/12*** | (2006.01) |
| ***G09F 19/00*** | (2006.01) |
| ***G09F 19/22*** | (2006.01) |
| ***E01F 9/04*** | (2006.01) |

(52) U.S. Cl.

CPC ..... *G09F 19/228* (2013.01); *E01F 9/042* (2013.01); *E01F 9/06* (2013.01); *G09F 7/12* (2013.01)

USPC ..... 404/12; 40/594; 40/615

(58) Field of Classification Search

CPC ..... E01F 9/042; E01F 9/083; E01F 9/06; E01F 9/044; E01C 23/206

USPC ..... 404/12, 14; 116/63 R; 40/611, 615, 594

See application file for complete search history.

(56) References Cited

U.S. PATENT DOCUMENTS

| | | | |
|---|---|---|---|
| 4,075,049 | A | 2/1978 | Wood |
| 4,142,265 | A | 3/1979 | Pfleger |
| 4,361,328 | A | 11/1982 | Stein et al. |
| 4,717,620 | A | 1/1988 | Bowen et al. |

(Continued)

FOREIGN PATENT DOCUMENTS

| | | |
|---|---|---|
| WO | 2007143988 A1 | 12/2007 |
| WO | 2011066348 | 3/2011 |

*Primary Examiner* — Abigail A Risic

(74) *Attorney, Agent, or Firm* — Guerry L. Grune; ePatentManager.com

(57) ABSTRACT

The present disclosure describes preformed pre-bonded thermoplastic sections comprising smaller articles where the articles and sections have planar top surfaces and planar bottom surfaces that are coplanar to each other. There is also an adhesive backing layer on the coplanar bottom surfaces so that the adhesive backing layer bridges and bonds coplanar bottom surfaces to form unified pre-bonded thermoplastic signage thereby preventing dislodging or separation of the signage during handling, movement, and/or transportation before or during application of the pre-bonded signage. The articles when properly sequenced, matched, and combined, together makeup the sections such that when the sections are also sequenced and matched the sections combine to form thermoplastic signage with a final pattern wherein the planar top surfaces include sequential features necessary to visibly aid in quick assembly of one or more unified thermoplastic signages.

4 Claims, 2 Drawing Sheets

(56) References Cited

U.S. PATENT DOCUMENTS

| | | | |
|---|---|---|---|
| 5,437,907 | A | 8/1995 | Peil et al. |
| 5,557,461 | A | 9/1996 | Wyckoff |
| 5,593,246 | A | 1/1997 | Hedblom et al. |
| 5,804,285 | A | 9/1998 | Kobayashi et al. |
| 5,861,206 | A | 1/1999 | Jensen |
| 6,020,047 | A | 2/2000 | Everhart |
| 6,413,010 | B2 | 7/2002 | Coleman |
| 6,431,788 | B1 | 8/2002 | Hedblom et al. |
| 6,576,074 | B1 | 6/2003 | Cabrera et al. |
| 6,656,566 | B1 | 12/2003 | Kuykendall et al. |
| 6,656,567 | B1 | 12/2003 | Abe et al. |
| 6,694,652 | B1 | 2/2004 | Jeha |
| 6,830,475 | B2 | 12/2004 | Jazowski et al. |
| 7,753,616 | B2 | 7/2010 | Greer et al. |
| 2006/0285920 | A1 | 12/2006 | Gettig et al. |
| 2007/0077119 | A1 | 4/2007 | Northey et al. |
| 2008/0145146 | A1 | 6/2008 | Shipman et al. |
| 2008/0236008 | A1 | 10/2008 | Greer et al. |
| 2011/0123769 | A1 | 5/2011 | Greer et al. |

COMPOSITION AND SYSTEM FOR PREFORMED THERMOPLASTIC ROAD MARKING WITH SEQUENTIAL FEATURES

PRIORITY

The present application is a continuation of and claims priority under 35 U.S.C. §120 from U.S. patent application Ser. No. 12/592,448 filed on Nov. 25, 2009 entitled "Composition and System for Preformed Thermoplastic Road Marking with Sequential Features" and U.S. patent application Ser. No. 10/816,635 entitled, "Pavement Marking Pattern and Method", filed 2 Apr. 2004, and granted in the United States on Jan. 12, 2010 as U.S. Pat. No. 7,645,503. Priority is also claimed under 35 U.S.C. §365(c) of PCT application PCT/US2010/057947 filed Nov. 24, 2010 entitled "Composition and System for Preformed Thermoplastic Road Marking with Sequential Features." In addition this application hereby expressly incorporates by reference, in its entirety, the same US and PCT applications provided above.

FIELD OF DISCLOSURE

The present invention relates to a system, method, and composition for preformed signage including; warning devices, pavement markings and traffic control devices that are comprised of alkyd resin based compositions for adhesion to paved surfaces and also pertains to pavement marking patterns utilizing two or more independent sections for which an adhesive is provided to maintain the integrity of the pattern prior or during its application to a substrate and more specifically including integral sequential features to ensure proper relational placement and installation of the pavement marking patterns.

BACKGROUND

Pavement markings convey information to drivers and pedestrians by providing exposed visible, reflective and/or tactile surfaces that serve as indicia upon a traffic surface. In the past such a function was typically accomplished by painting a traffic surface. Modern pavement marking materials offer significant advantages over paint such as dramatically increased visibility and/or retro reflectance, improved durability, and temporary removable marking options. Examples of modern pavement marking materials are thermoplastic, preformed pavement marking sheet materials, tapes and raised pavement markers.

Signage in many cases is shipped to the job site as articles of the whole, depicting specific information or a visual theme and requiring assembly of the articles into the desired pattern. Assembly steps, without sequential assembly indicators, consume time and effort and pose a risk that the completed signage may be incorrect after adhesion to the pavement surface.

The thermoplastic signage may be hydrocarbon or alkyd based and includes a hot melt thermoplastic application. Thermoplastic signage must meet the standard specifications as published in the AASHTO—American Association of State Highway Transportation Officials). Designation: M 249-98

Traffic surfaces include areas for pedestrians, motorized vehicles, aircraft, human powered conveyances, programmable robotics and may be horizontal or vertical.

In recent years increasing numbers of municipalities, office complexes, shopping centers and other commercial developments have utilized thermoplastic pavement markings with various patterns and designs to guide, decorate and protect high traffic areas such as highways, pedestrian crosswalks, parking lots and business entrances. A typical, conventional pavement marking pattern as set forth in PCT application US/03/03156 (WO 03/064771 A1) consists of a preformed planar thermoplastic sheet or strip having a thickness of approximately 0.01" (2.5 mm). The widths of these patterns vary with the purpose of the marking Such patterns may include a first section or grid, for example to represent the mortar joints in a "brick" design and a plurality of second sections or "bricks" which are coplanar therewith, usually in a color different from the mortar color. The second section or bricks which are separately manufactured are inserted into the first section or grid before application of the pattern to the pavement. Various such two section marking patterns are commonly available such as: herringbone, standard brick, cobblestone, paving slabs and many other designs (which are constantly evolving). Marking patterns with more than two sections are also commonly available such as horizontal highway and street signage, logos and many others.

As hereinbefore mentioned, these marking patterns consist of two or more independent sections which must be carefully assembled and handled before applying to pavements such as asphalt, concrete or other suitable substrates. These marking patterns are placed at desired locations such as road crosswalks, intersections, parking lots or other sites. In some cases heat is then applied to soften the pavement marking pattern causing it to firmly adhere to the substrate. Various adhesives can also be used to adhere the marking pattern to the substrate.

While the purchase of such pavement marking patterns is relatively inexpensive, much time and labor is devoted to the assembly and application of the pattern to the substrate. Most patterns consist of two or more sections which are independently formed for manual assembly at the job site and time and effort is needed to assemble and maintain the integrity of a pattern before the heat treatment. Usually the pattern placed on the substrate must be moved manually for adjustment purposes. During such movement, the independent sections in the pattern inadvertently become unaligned, requiring reinsertion or realignment. If the realignment is not precisely accomplished, the marking pattern will have lost its integrity and the entire pattern must be removed manually from the substrate, the substrate cleaned and a second attempt at the application made with the reinserted or new marking pattern. This re-application results in extra time, labor and materials. In the past, to maintain the integrity of the marking pattern before the heat treatment and during the handling and placement, "spot adhesives" have been used which remain somewhat "tacky" after being applied to the bottom of the patterns at the grid intersections to maintain pattern integrity. However, these small adhesive circles or "spots" are generally a different type of polymer than the marking pattern and can prevent proper attachment and easy movement of the marking pattern on the substrate at the spot adhesive locations before and during the heat application of the marking Also, certain spot adhesives are not compatible with the plastic materials from which the patterns are formed and can cause the pavement marking sections to separate from the substrate after the heat application, as only a weak bond is formed with the substrate.

Specifically, the standard for thermoplastic marking bond strength can be found in ASTM D4796, which states the test method and bonding strength of thermoplastic signage to concrete as: Bond Strength—After heating the thermoplastic material for four hours at 425 degrees F. the bond strength to Portland Cement Concrete shall exceed 1.24 Mpa (~180 psi). Preferably the bond strength is from about 200 psi to about 500 psi.

Thermoplastic signage must reach a softening point within a range of about 400 degrees F. to about 450 degrees F. as determined by the ring and ball softening point test method specified in AASHTO Designation: M 249, section 12 in order to properly adhere to most pavement surfaces.

Alkyd resins are the reaction product of an oil or fatty acid, polyol(s) and polyacids. Alkyds can also be modified or co-reacted with many other material types (rosin, phenolic, urethane, vinyl monomers etc.). The precise combination of the many possible ingredients, together with careful control of the reaction, influences the final properties of the alkyd produced.

RELEVANT ART

U.S. Pat. No. 5,861,206, to Jensen, Hans Falkner, and assigned to Cleanosol International AB, describes a pre-manufactured surface covering having a thermoplastic material for application to a paved surface by heating the thermoplastic material to a predetermined temperature at which the thermoplastic material adheres to a paved surface. The thermoplastic material road marker includes road marking material selected from the group consisting of reflective materials or friction materials and a visible temperature indicator, such that during heating of the thermoplastic material road marking material to the paved surface the predetermined temperature may be visibly indicated.

U.S. Pat. No. 4,142,265, to Pfleger, Albert, and unassigned, describes a self-supporting plastic shell structure, in particular a multilayered boat hull shell, formed of elongate thermoplastic shapes placed in contact one against another to form a basic shell and covered with laminates of fiber-reinforced hardenable plastics material. The shapes forming the basic shell are flexible and of uniform cross section and form outwardly opening longitudinal grooves along their areas of mutual contact, the contacting top and bottom ends of the cross sections of adjacent shapes being configured to rest one within the other, but being noncomplementary in configuration and free of snap-fit relation. The shape has spaced opposed sidewalls, a top end which is a shallow V-cross section top wall connecting the sidewalls and forming a channel, and a bottom end which is a convexly rounded bottom wall connecting the sidewalls. The convexly rounded bottom wall of one shape contacts the V-cross section top wall of the next shape and is engageable simultaneously with both ramps of the shallow V-cross section top wall through a range of angles corresponding to the angle between the ramps of the shallow V-cross section top wall. A thermosetting or hardenable filler material fills the longitudinal grooves and the laminate covering side surfaces of the shapes and intervening filler material. The method of assembly includes leveling uneven areas formed on the surfaces of the basic shell by hot pressing prior to filling the grooves.

U.S. Pat. No. 6,020,047, to Everhart, Dennis S., and assigned to Kimberly Clark Worldwide, describes a film with patterned self-assembling monolayers having a polymer film coated with a metal alloy and a self-assembling monolayer printed onto the polymer film.

U.S. Pat. No. 6,694,652, to Jeha, George, and unassigned, describes a raised surface sign having a sign face layer with a substantially transparent, conformable, thermoplastic sheeting with an exposed face surface with raised Braille characters, one or more visual characters underlying the sign face layer; one or more raised, 3-D characters in the form of a 3-D layer positioned beneath and in register with the one or more visual characters and a principal background colour layer underlying either the one or more visual characters or both the one or more visual characters and the 3-D characters. An outer principal background colour layer border with a colour layer surface with a specific colour and a substrate layer underlying the principal background colour layer and having a substrate underside and top side surface and a substrate border with a region of the substrate border that is displaced vertically with respect to the top side surface to form a Braille locator region. The Braille locator region is spanned by a coloured Braille locator spanning surface that is of the same colour as the colour of the surface of the outer colour layer border to minimize visual contrast along the substrate border between the Braille locator region and the outer layer border.

U.S. Pat. No. 6,830,475, to Jazowski, et. al., and assigned to Homac Mfg. Co., describes an electrical connector having a connector body with a through passageway with a first end for receiving an electrical bushing insert, and a second end for receiving an electrical conductor. The connector body has a first layer adjacent to the passageway and having a material with a relatively low resistivity, a second layer surrounds the first layer and having a material with a relatively high resistivity, a third layer surrounding the second layer and having a material with a relatively low resistivity. The connector body has an outer end portion adjacent to the first end of the passageway and is movable between an unseated position and a seated position onto the electrical bushing insert and indicia having a colored band surrounding the outer end portion of the connector body visibility changing to indicate the seated position.

U.S. Pat. No. 5,804,285, to Kobayashi, et. al., and assigned to Dai Nippon Printing Co. Ltd., describes a decorative sheet having a transparent thermoplastic resin film with a back surface provided with a printed pictorial pattern; a lustrous layer with a back surface formed on the back surface of the transparent thermoplastic resin film; and a colored thermoplastic resin film having a back surface formed on the back surface of the lustrous layer, where a first, a second and a third embossed pattern are formed in the back surface of the colored thermoplastic resin film. The embossed layers are in the interface between the colored thermoplastic resin film and the lustrous layer and in an interface between the lustrous layer and the transparent thermoplastic resin film, respectively, and where respective outlines of cross sections of the second and the third embossed patterns formed respectively in the interface between the colored thermoplastic resin film and the lustrous layer and in the interface between the lustrous layer and the transparent thermoplastic resin film have of smooth curves expressed by periodic functions.

U.S. Pat. No. 6,656,566, to Kuykendall, et. al., and assigned to 3M, describes a sheeting material having retroreflective and luminescent properties consisting of a retroreflective layer consisting of retroreflective sheeting having upper and lower surfaces, a luminescent layer consisting of a photoluminescent film disposed upon the upper surface of the retroreflective layer, where the luminescent layer has one or more openings and each of the openings in the shape of a letter or symbol. An optional pattern is printed on at least one of the retroreflective layer and the luminescent layer and an optional layer of adhesive is disposed on the lower surface of the retroreflective layer.

SUMMARY OF THE DISCLOSURE

The present disclosure relates to a system, a method, and composition for alkyd resin based preformed thermoplastic detectable warning devices, pavement markings and traffic control devices (turn arrows, stop bars) that contain features such as an indent, dimple, bump or other deformable marker in combination with integral sequential features to aid in proper assembly on a pavement surface. The preformed thermoplastic is heated to a desired temperature to provide permanent pedestrian and traffic control pavement markings.

Other objectives are realized by providing a conventional pavement marking pattern formed of a thermosetting or thermoplastic initially comprised of multiple articles that ultimately comprise two or more sections with sequential features, These sections can be manually joined by bridging the bottom surface thereof with an adhesive having substantially the same temperature softening point as other sections with the marking pattern. The adhesive is sprayed primarily along the intersections of the pattern to cover a percentage (approximately 5-90%) of the bottom surface area while bridging the intersections. The more intricate the surface pattern (more joints and intersections) the greater the percentage of coverage required. The spray adhesive can be a typical polyamide, EVA based hot melt adhesive or other adhesive systems as required and preferably consists of a hot melt polyamide resin based adhesive which is sprayed in a circular or spiral string like configuration at a temperature at or above its softening point.

The sprayed hot adhesive strikes the marking pattern and adheres, bridging and bonding the patterned sequential feature sections to maintain pattern integrity during subsequent handling. Uni-Rez 2633 as sold by Arizona Chemical Company of P.O. Box 550850, Jacksonville, Fla. 32225 is a main ingredient of choice in the preferred hot melt adhesive. The preferred hot melt adhesive is formulated with Uni-Rez 2633, ester modified rosins, fillers, extenders, levelers and other conventional filler components.

In a typical manufacturing process, various sections of a pavement marking pattern (e.g. highway and airport runway patterns) can either be factory assembled or assembled at the installation site using the sequential features for matching the sections properly and efficiently. While in assembled form, the bottom of the pattern is sprayed with the hot melt adhesive described above preferably using a spray gun model: Hysol-175-sprayer as manufactured by Loctite Corporation of 1001 Trout Brook Crossing, Rocky Hill, Conn. 06067. The spray gun has various pressures and nozzle settings to select from, depending on the viscosity of the particular adhesive employed. A circular or spiral string-like adhesive configuration is preferred for the spray.

Once the sprayed hot melt adhesive has cooled, the sequentially labeled sections are suitably bridged and joined and the pavement marking pattern is packaged for shipment. Upon receipt at the job site, the packages are opened and after the intended substrate, usually asphalt or concrete is properly cleaned and swept, the marking pattern is then placed on the substrate without concern of disassembly during handling, movement and adjustment.

Once suitably placed, a heat application is delivered from a conventional source which softens the marking pattern and the underlying sprayed adhesive, both of which have the approximate same temperature softening point to thereby affix the pavement marking pattern to the substrate. Time and labor are thereby saved as the marking pattern sections have been adhered to form a unified pattern by the hot melt adhesive.

One embodiment of the preformed thermoplastic compositions includes alkyd resins of the present disclosure and has been formulated to mimic the properties of C5 hydrocarbons which are normally more costly and less stable over time.

The present formulation instead generally comprises;

Resin (18-30%)

Takifier resin which may be a malic or fumaric acid modified rosin ester, plasticizer such as DINP (di-isononyl phthalate), vegetable oils, phthalate esters, mineral oil, castor oil, wax/flexibilizer, paraffin wax, thermoplastic polyurethane, polyamides, ethylene vinyl acetate (EVA) or styrene-butadiene-styrene (SBS) elastomers.

Pigment (2-10%)

Titanium dioxide, lead chromate and organic dyes.

Filler (60-80%)

Calcium carbonate, glass beads, fumed silica, and aggregate.

A primary embodiment of the present disclosure is the incorporation of integral sequential features which may be alphanumeric symbols, shapes or sequences of shapes or a combination of alphanumeric symbols and shapes and sequence of shapes.

In another embodiment the alkyd resin preformed thermoplastic signage and/or devices may be accompanied with a template defining specific shapes for visually identifying and selecting components of the detectable warning device where the integral sequential features identify the assembly sequence.

In an embodiment a feature such as an indent, dimple, bump or other deformable marker and the integral sequential feature of the preformed thermoplastic signage deform when heated to visibly indicate when the preformed thermoplastic signage is sufficiently heated to adhere and conform to the surface shape to which it applied.

In another embodiment the visible temperature indicator remains visible in whole or in part if the predetermined temperature is not attained. Failure analysis of each section of the preformed thermoplastic signage is enhanced by examining the cross section of each visible temperature indicator feature or deformable marker, whether remaining raised or the depth to which each slit remains within the preformed thermoplastic signage which would indicate the preformed thermoplastic signage was not properly heated at the time of installation.

In another embodiment the integral sequential feature is an alphanumeric slit into sections of the preformed thermoplastic detectable warning device which enables assembly by visually identifying which preformed thermoplastic detectable warning sections abut to each other prior to heating and adhesion to the pavement surface.

In yet another embodiment the sequential alphanumeric slit of the preformed thermoplastic detectable warning sections melt as the desired temperature is reached during the heating step indicating proper thermoplastic melting temperature and causing the sequential features and temperature indicating features to disappear.

In another embodiment the preformed thermoplastic detectable warning sections have at least one reflective bead embedded into the surface.

In another embodiment the melted sequential alphanumeric slit of the reflective preformed thermoplastic detectable warning sections ensures the visual integrity of the signage.

In another embodiment reflective beads may be applied to the alkyd resin preformed thermoplastic detectable warning device during manufacture or may be added into the melted alkyd resin preformed thermoplastic detectable warning device forming a reflective alkyd resin thermoplastic preformed thermoplastic detectable warning device.

In another embodiment the reflective beads are from 0.01 to 5 mm in diameter.

In another embodiment the reflective beads may be smooth or textured.

In another embodiment the reflective beads are embedded into the reflective preformed thermoplastic detectable warning device from 20-80%.

In another embodiment the preformed thermoplastic signage does not require preheating of Portland cement, concrete or asphalted pavement surface.

In another embodiment the preformed thermoplastic signage does not require removal of laitance on Portland cement or concrete and can be used on surfaces that remain moist throughout their lifetime due to lack of water drainage in the surrounding area.

Additionally there is also a need for taxiway and runway signage that is relatively quick to apply that will exhibit exceptional wear characteristics, allow for delaying intervening scheduled maintenance, and assist with reduction of the cost of maintenance, inconvenience of delayed flights and confusion due to taxiway and runway rerouting.

In an additional embodiment, the pre-manufactured thermoplastic signage is an alkyd thermoplastic product with the addition of an aliphatic polyether based polyurethane composition for flexibility and impact resistance.

In another embodiment the pre-manufactured thermoplastic signage is prepared to meet specific lengths and widths conforming with FAA Standards AC 150/5340-1 "Standards for Airport Indicia" and AC 150/5340-18 "Standards for Airport Sign Systems" for touchdown indicia, threshold indicia configurations, aiming point indicia and centerlines, as requirements for precision instrument runways.

In yet another embodiment the pre-manufactured thermoplastic signage is provided as alpha-numeric symbols for specific information signage that is applied to the runway, taxiway or holding surface.

In another embodiment the pre-manufactured thermoplastic signage is available in various colors or hues.

In another embodiment the pre-manufactured thermoplastic signage has features that allow the edges to physically interconnect and interlock.

In yet another embodiment the pre-manufactured thermoplastic signage is constructed with skid resistant materials for high skid resistance and additional safety.

An embodiment of the disclosure is that the pre-manufactured thermoplastic signage is available for traffic within minutes of adhering the specific signage.

Additionally as another embodiment, the pre-manufactured thermoplastic signage identifies areas for aircraft support vehicles or outdoor passenger loading in non-runway areas.

An additional embodiment for the pre-manufactured thermoplastic signage identifies specific helicopter landing and takeoff areas including medical transport.

Thus with the problems and difficulties associated with maintaining the integrity of the pavement marking patterns during handling and application at the job site, the present invention was conceived and one of its objectives is to provide an improved pavement marking pattern in which the pattern sections are properly connected during handling and installation on a selected substrate.

It is another objective of the present invention to provide a relatively inexpensive pavement marking pattern having two or more sections in which the sections are joined by use of an applied adhesive.

It is yet another objective of the present invention to provide a method for forming a pavement marking pattern which allows cost efficient factory assembly of the pattern and which prevents dislodging and separation of the pattern sections during handling, transportation and application. It is still another objective of the present invention to provide an adhesive which can be conveniently sprayed onto the back of pavement marking patterns which will sufficiently adhere thereto and prevent separation of the sections during handling, and not deteriorate the bond between the pavement marking pattern and the substrate.

It is still another objective of the present invention to provide a method for easy application of the adhesively sprayed marking pattern to the substrate.

Various other objectives and advantages of the present invention will become apparent to those skilled in the art as a more detailed description is set forth below.

DETAILED DESCRIPTION OF THE DRAWINGS

Figure 1:
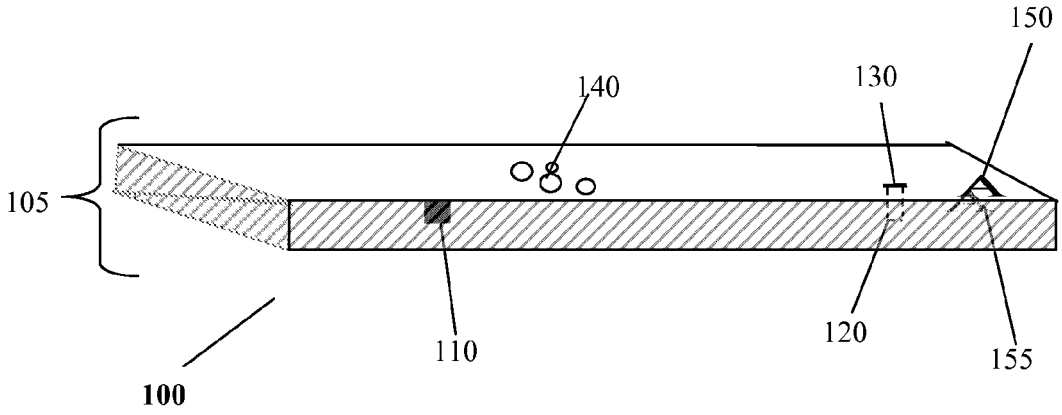
FIG. 1 is an isometric cross section of an alkyd resin preformed thermoplastic detectable warning device section with disclosed temperature indicating features, reflective beads and sequential assembly features.

FIG. 1 is an isometric cross section of the preformed thermoplastic signage articles [100] having a alkyd resin based preformed thermoplastic sheet [105] with an optional temperature indicating feature such as, but not limited to, an indent [110], a dimple [120] a bump [130], an alphanumeric slit [150] or any other heat deformable marker that visibly deforms when heating elevates the temperature of the thermoplastic signage articles [100] to a desired temperature. These articles may be individual pieces of differing shapes or full rolls of thermoplastic sheathing. When the desired temperature is reached, the temperature indicating features [110, 120, 130, 150] visibly reforms becoming a blended surface according to the traffic surface shape to which it is applied.

The surface of the preformed thermoplastic signage articles [100] may have reflective beads [140] of glass or ceramic, embedded into the preformed thermoplastic sheet [105]. The reflective beads [140] may be smooth or textured. Also optionally included are anti-skid materials to improve friction such as corundum or crushed glass.

Figure 1A:
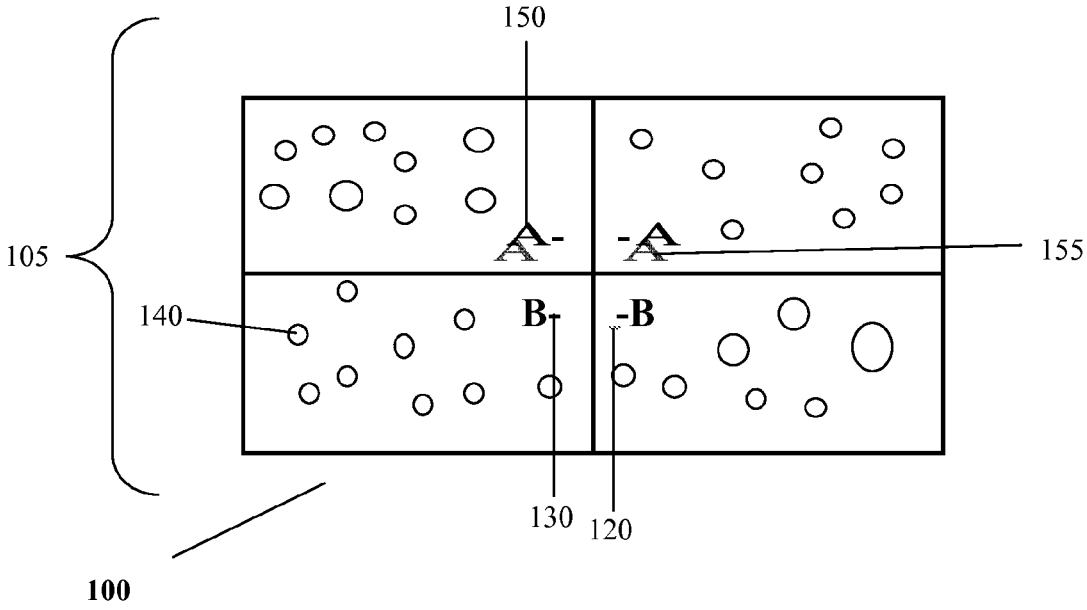
FIG. 1A is a top view of an assembled alkyd resin preformed thermoplastic detectable warning device with the preformed thermoplastic detectable warning device assembled using sequential indicators.

For FIG. 1A, the sequential features shown in FIG. 1 are noted by the alphanumeric slit [150] formed as the letter A with the slit depth [155] shown as hidden lines. The sequential feature may include a series of alphanumeric or symbols and has the dual purpose of initially indicating placement of each preformed thermoplastic articles [100] in relation to another article of preformed thermoplastic to complete the preformed signage section (shown in FIG. 2) as well as providing the visible disappearance of the sequential features when the preformed thermoplastic sheet [105] is heated, reaches the desired temperature and melts the slit depth [155] and alphanumeric slit [150] into a singular preformed thermoplastic section (shown in FIG. 2) and device.

If the temperature indicating features [110, 120, 130, 150] remain and failure occurs at a later date, these features would also be indicative of the fact that the preformed thermoplastic signage articles [100] was improperly applied to the pavement substrate (not shown).

Figure 2:
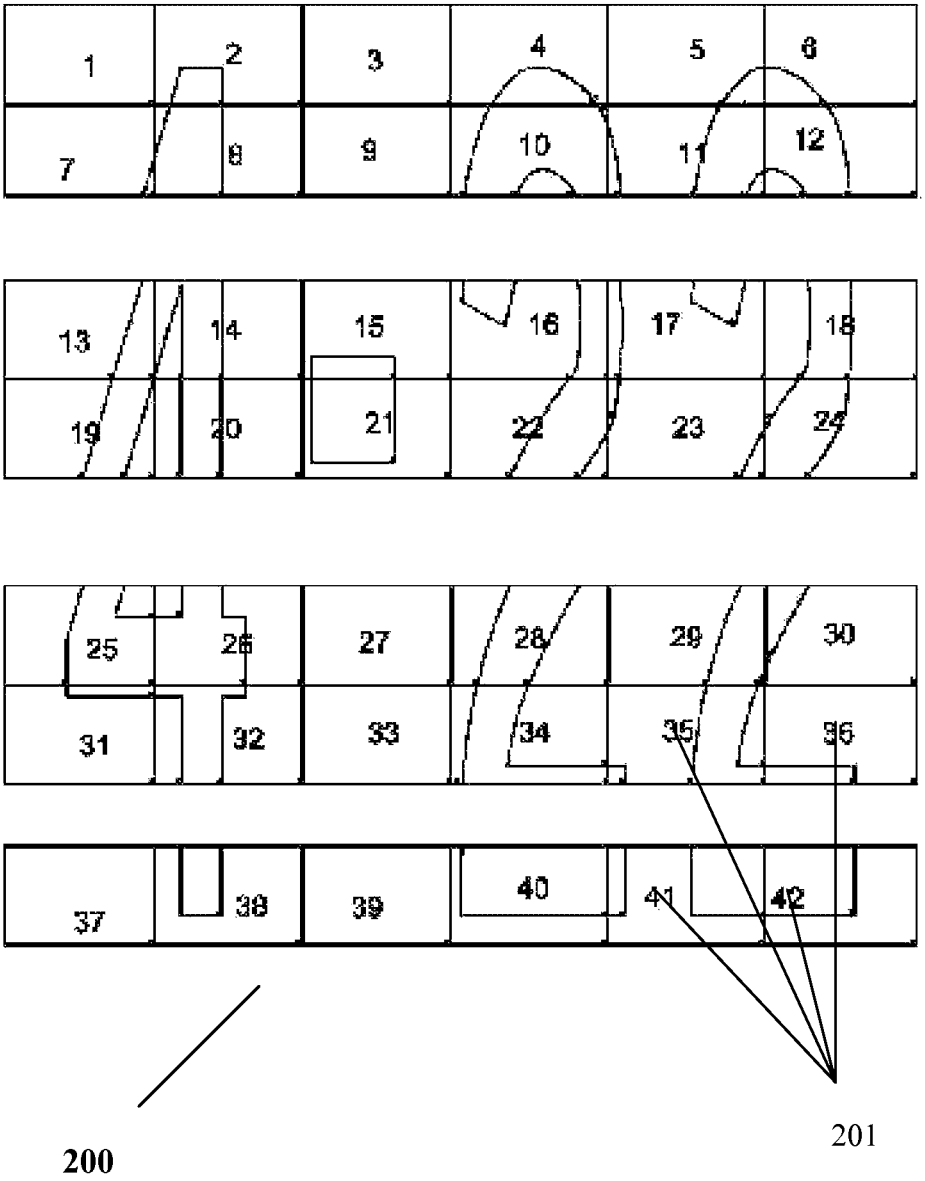
FIG. 2 is a schematic of articles comprising a section that is complete with sequential features.

FIG. 2 is a schematic of articles comprising a section that is complete with sequential features [200]. The sequential features in this case are shown [201] as numerics that correspond to particular sections numbered to coincide with the complete (larger) desired pattern [200].

DETAILED DESCRIPTION

The present disclosure relates to a method for adhering preformed thermoplastic signage markings (e.g. for pavement substrates) that contain features such as an indent, dimple, bump, sequential alphanumeric slits or other markers that are provided on the surface of alkyd thermoplastic compositions (generally known as thermoplastic signage) to traffic surfaces to provide permanent pedestrian and traffic control markings.

A representative example of the composition of these preformed thermoplastic sections or rolls is given below:

Polyamide, Unirez 2633, Arizona Chemical 8%
Wax, Clarient PE-520 2%
Plasticizer, DINP di-isononyl phthalate 4%
Tackifier Resin, Sylvacote 7021, Arizona Chemical 8.5%
Fumed silica, Cabot TS-720, 1%
Calcium Carbonate, 36.5%
AASHTO Type 1 intermix beads, 30%
Titanium Dioxide, 10%

Heating of the surface of the thermoplastic signage may be accomplished by a heating means such as a propane-fueled infrared heater, the FLINT 2000EX® heat gun, manufactured by Flint Trading, Inc., or can be accomplished with an open flame, a closed flame, by heated rollers, electrically resistive heating or other means known to those skilled in the art.

The heat source is then removed from the thermoplastic signage and the mixture is allowed to cool thereby returning the mixture from a molten state to a semi-molten state and finally to a hardened state as one substance that includes the (normally paved) substrate.

The application of cool water after a heated state will hasten solidification, strengthening and curing of the mixture.

Prior to installation, within the manufacturing site, the thermoplastic signage is created by using steel rule dies or a water jet (which may also be a laser or other appropriate energy source) to cut out the necessary patterns (sequential numbers or codes or letters) from usually 3 or more large sheets of differing colors of thermoplastic. The sequential patterns are cut into the solid sheets using the water jet which allows for fast matching and assembly either within the manufacturing facility or at the construction (paving) site. As the thermoplastic signage is heated, the number, code or letter (necessary pattern) disappears as the thermoplastic itself begins to soften and flow during application.

With the use of steel rule dies or the water jet (or laser or other suitable energy source capable of cutting patterns into the preformed thermoplastic sheets), the ability to provide very thinly cut patterns (usually alpha-numeric designations) is possible. This allows for providing patterns that more easily disappear during the heated application described above.

What is claimed is:

1. Preformed pre-bonded thermoplastic sections comprising smaller articles; said preformed thermoplastics consisting of; articles and sections are consisting of planar top surfaces and planar bottom surfaces that are coplanar to each other, and further consisting of an adhesive backing layer on said coplanar bottom surfaces, said adhesive backing layer bridging and bonding said coplanar bottom surface to form unified pre-bonded thermoplastic signage thereby preventing dislodging and/or separation of said signage during handling, movement, and/or transportation before or during application of said pre-bonded signage and wherein said articles when properly sequenced, matched, and combined, together comprise said sections such that when said sections are also sequenced and matched said sections combine to form thermoplastic signage with a final pattern wherein said planar top surfaces include sequential features necessary to visibly aid in quick assembly of one or more unified thermoplastic signages wherein said thermoplastic sections include road marking materials, reflective materials, friction materials, and at least one visible temperature indicator, whereby during heating of said thermoplastic marking grid said predetermined temperature may be visibly indicated, wherein said articles consist of at least one said alphanumeric slit as a sequential feature as an indicator for assembly and abutting said articles into said sections and for assembly and abutting said sections into said unified thermoplastic signages and wherein said alphanumeric slit is also a temperature indicator visibly indicating when said predetermined temperature is attained.

2. The preformed pre-bonded thermoplastic sections of claim 1, wherein said sections include a group consisting of; a marking grid, a plurality of inserts, and an insert pattern each of said inserts separated by said grid.

3. A method of making preformed pre-bonded thermoplastic sections comprising smaller articles that include a thermoplastic marking grid substrate consisting of; road marking materials, reflective materials, friction materials, and at least one visible temperature indicator, whereby during heating of said thermoplastic marking grid a predetermined temperature is visibly indicated during adherence to a paved surface and wherein said visible temperature indicator consists of at least one indent, dimple, bump, and alphanumeric slit disposed in the surface of said thermoplastic sections and wherein said articles of said sections comprises at least one said alphanumeric slit as a sequential feature as an indicator for assembly and abutting said articles into said sections and for assembly and abutting said sections into said unified thermoplastic signages and wherein said alphanumeric slit is also a temperature indicator visibly indicating when said predetermined temperature is attained.

4. The method of claim 3, wherein said sections are from the group consisting of a marking grid, a plurality of inserts and an insert pattern such that each of said inserts is separated by said grid.

* * * * *